United States Patent [19]

Pell

[11] 4,132,628

[45] Jan. 2, 1979

[54] METHOD FOR RECOVERING HYDROCARBONS FROM MOLTEN METAL HALIDES

[75] Inventor: Melvyn B. Pell, Bethel Park, Pa.

[73] Assignees: Continental Oil Company, Stamford, Conn.; The United States of America as represented by the United States Department of Energy, Washington, D.C.

[21] Appl. No.: 824,181

[22] Filed: Aug. 12, 1977

[51] Int. Cl.[2] ..... C10G 13/08; C01G 9/04

[52] U.S. Cl. ..... 208/108; 208/10; 252/414; 423/1; 423/99; 423/DIG. 12

[58] Field of Search ..... 208/108, 10; 252/414; 423/1, 99, DIG. 12

[56] References Cited

U.S. PATENT DOCUMENTS

| | | | |
|---|---|---|---|
| 3,355,376 | 11/1967 | Gorin et al. | 208/10 |
| 3,371,049 | 2/1968 | Gorin et al. | 252/413 |
| 3,505,206 | 4/1970 | Decker | 208/108 |
| 3,505,207 | 4/1970 | Haney et al. | 208/108 |
| 3,594,329 | 7/1971 | Gorin et al. | 252/417 |
| 3,679,577 | 7/1972 | Wantland et al. | 208/108 |
| 3,736,250 | 5/1973 | Berg et al. | 208/10 |
| 3,764,515 | 10/1973 | Kiovsky | 208/10 |
| 3,790,468 | 2/1974 | Loth | 208/10 |

*Primary Examiner*—Delbert E. Gantz
*Assistant Examiner*—G. E. Schmitkons
*Attorney, Agent, or Firm*—F. Lindsey Scott; W. A. Mikesell, Jr.; D. Leigh Fowler, Jr.

[57] ABSTRACT

In a process for hydrocracking heavy carbonaceous materials by contacting such carbonaceous materials with hydrogen in the presence of a molten metal halide catalyst to produce hydrocarbons having lower molecular weights and thereafter recovering the hydrocarbons so produced from the molten metal halide, an improvement comprising injecting into the spent molten metal halide, a liquid low-boiling hydrocarbon stream is disclosed.

5 Claims, 1 Drawing Figure

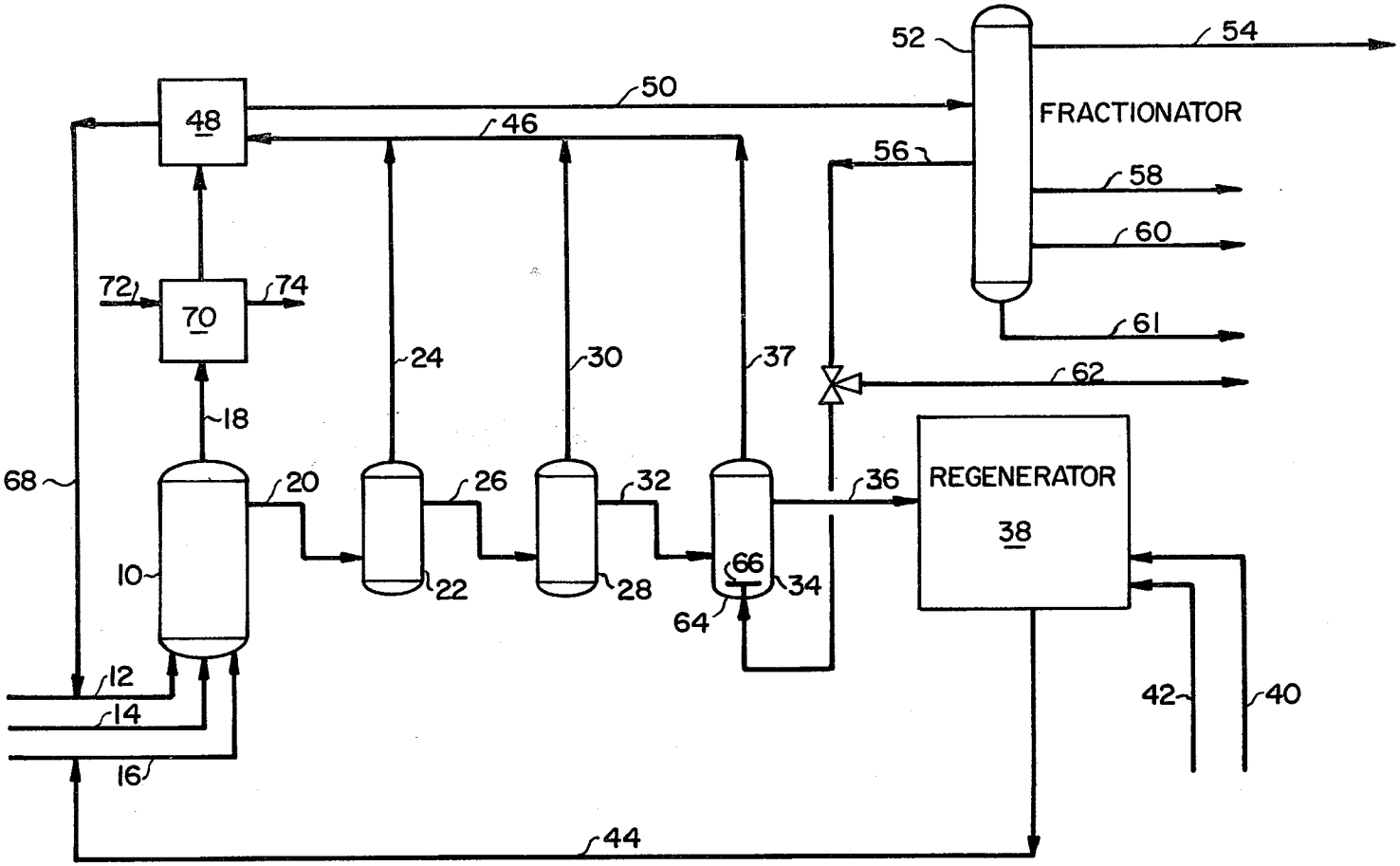
FRACTIONATOR
REGENERATOR
38
54
58
60
61
62
40
42
52
56
36
37
34
66
64
50
32
28
30
44
46
26
22
24
20
74
18
48
70
72
10
12
14
16
68

METHOD FOR RECOVERING HYDROCARBONS FROM MOLTEN METAL HALIDES

This invention resulted from work done pursuant to a contract with the United States Energy Research and Development Administration.

This application relates to the conversion of heavy hydrocarbonaceous materials into lower molecular weight hydrocarbons by reaction with hydrogen in the presence of a molten metal halide catalyst.

This invention further relates to an improvement in methods for hydrocracking heavy hydrocarbonaceous materials by reacting such materials with hydrogen in the presence of a molten metal halide catalyst wherein a liquid low-boiling hydrocarbon stream is introduced into the spent molten metal halide.

As a result of the continuing well-known shortage of petroleum products such as gasoline, diesel fuel, natural gas and the like, a continuing effort has been devoted to the development of alternative fuel sources which do not depend upon petroleum as a feedstock. In particular, a considerable amount of effort has been devoted in recent years to the development of processes which will produce liquid and gaseous hydrocarbon fuels from coal feedstocks.

One such process is the reaction of carbonaceous materials such as coal with hydrogen in the presence of molten metal halides to produce gasoline-range materials and other lower molecular weight products. One such process is shown, for instance, in U.S. Pat. No. 3,355,376, issued Nov. 28, 1967 to Gorin et al. Such processes have utilized various metal halides with zinc chloride being preferred. In such processes, the lower molecular weight product hydrocarbons are normally recovered from the reaction zone either as a gaseous stream or in mixture with the spent molten metal halide. The mixture is subjected to flashing or distillation to recover the product hydrocarbonaceous materials from the molten metal halide. Even after such distillation or flashing, considerable amounts of the heavier product hydrocarbons remain with the molten metal halide and present problems in the regeneration of the molten metal halide and the like. Desirably, these heavier molecular weight hydrocarbon materials are recovered from the molten metal halide. Considerable effort has been devoted to the development of methods whereby increased amounts of the heavier hydrocarbonaceous materials can be so recovered.

It has now been discovered that such improved recoveries are accomplished by injecting into the molten metal halide a liquid low-boiling hydrocarbon stream.

The low-boiling hydrocarbon stream vaporizes in the molten metal halide melt and provides an improved recovery of heavier hydrocarbonaceous materials therefrom.

The FIGURE is a schematic flowsheet of a process wherein the improvement of the present invention is utilized.

In the FIGURE, a reactor 10 is shown equipped with a hydrogen inlet 12, a carbonaceous feed inlet 14 and a metal halide inlet 16. Reactor 10 also includes a gas outlet 18 for the recovery of gaseous products as well as any unused hydrogen and the like, and a spent melt recovery line 20 for the recovery of the spent metal halide containing a portion of the reaction products. The spent melt is passed through line 20 to a first vessel 22 where the pressure is reduced and a portion of the hydrocarbonaceous material contained in the spent melt is distilled from vessel 22 through a line 24. The spent melt is then passed through a line 26 to a second vessel 28 where the pressure is further reduced and vaporous products are recovered through a line 30. The spent melt is then passed through a line 32 to a third vessel 34 where the pressure is again reduced and vaporous products are recovered through a line 37. The vaporous products recovered are passed through a line 46 which conveys them to a condenser 48 where the hydrocarbonaceous materials are condensed and passed via a line 50 to a fractionator 52. In fractionator 52, the product hydrocarbonaceous materials are fractionated into a plurality of product streams. For instance, the lightest stream produced is a stream 54 which could be propane, butane, or other natural gas-range materials, with a second stream being withdrawn through a line 56, a third stream being withdrawn through a line 58, a heavier carbonaceous material being withdrawn through line 60 and a bottoms stream being withdrawn through line 61. The materials withdrawn through lines 56, 58, 60 and 61 might correspond to a gasoline-grade material, a diesel fuel-grade material, a heavy oil fuel-grade material, and heavier materials. The bottoms stream may be recycled back to line 14 as a part of the charge to reactor 10, used as a heavy fuel etc. The spent melt withdrawn from third reaction vessel 34 is passed to a regenerator 38 where the metal halide is regenerated by processes such as shown, for instance, in U.S. Pat. No. 3,594,329, issued July 20, 1971 to Gorin et al. which is hereby incorporated by reference and discloses a method for the regeneration of a metal halide by combustion of the organic material contained in the spent molten metal halide. In general, the process comprises the combustion of the carbonaceous material to vaporize the metal halide to a condenser where it is collected with additional recovery being applied to recover any metal which has been converted to metal oxides, sulfides, or the like. The metal halide so recovered is desirably recycled to the inlet to reactor 10 via a line 44. The gaseous mixture produced in reactor 10 and recovered through line 18 is optionally passed through an HCl-removal section 70 where the HCl is removed by means known to those skilled in the art. One such method comprises scrubbing with a molten metal halide which has been subjected to ammoniation, thereby producing a mixture which is capable of absorbing acids. In one such embodiment, as shown for instance, in Consolidation Coal Company report to the Office of Coal Reseach, U.S. Department of Interior under Contract Number 14-01-0001-310, Vol. III, Book 1, issued Aug. 30, 1968; Consolidation Coal Company report to the Office of Coal Research, U.S. Department of Interior under Contract Number 14-01-0001-310, Vol. III, Book 2, issued Oct. 18, 1968; E. Gorin paper presented at the Spring Symposium of the Pittsburgh Catalysis Society, 1975 entitled "Hydrocracking of Coal by Molten Zinc Chloride Catalysts"; and Conoco Coal Development Company report entitled "Zinc Chloride Coal Liquefaction Process" by R. T. Struck, C. W. Zielke and Everett Gorin, prepared for ERDA under Contract Number E-(49-18)-1743 and issued Nov. 1, 1976, zinc chloride is used to absorb hydrochloric acid by the reactions shown:

$$ZnCl_2 + NH_3 = ZnCl_2 \cdot NH_3 \quad (1)$$

$$ZnCl_2 \cdot NH_3 + HCl = ZnCl_2 \cdot NH_4Cl \quad (2)$$

The disclosures in these reports are hereby incorporated by reference and it is to be clearly understood that other means known to those skilled in the art can be used to absorb the acids so produced. Since this stream is optionally recycled from condenser 48 via line 68 to reactor inlet 12, it is not necessary in all instances to collect the acids.

Having thus described the FIGURE, it is pointed out the the improvement of the present invention is effective with molten metal halides known to those skilled in the art such as, zinc chloride, zinc bromide, zinc iodide, antimony bromide, antimony iodide, tin bromide, titanium iodide, arsenic bromide, arsenic iodide and the like. Some such materials are set forth, for instance, in U.S. Pat. No. 3,764,515, issued Oct. 9, 1973 to Kiovsky. Further, the molten metal halide melt may include additives such as alkali metal iodides as shown, for instance, in U.S. Pat. No. 3,790,468 issued Feb. 5, 1974 to Loth. While it is preferred, in the practice of the present invention, that the metal halide used be zinc chloride, it is pointed out that the improvement of the present invention is effective with all such metal halides. In view of the fact that zinc chloride is the preferred metal halide, the invention will be described hereinafter with respect to zinc chloride.

In one process variation, the spent melt may be recycled to the reactor inlet to carry the carbonaceous feed into the reactor or the like. Such a recycle step is shown in U.S. Pat. No. 3,790,468, issued Feb. 5, 1974 to Loth, which is hereby incorporated by reference.

The carbonaceous feed to the reactor is desirably selected from coal of various types such as anthracite, bituminous, sub-bituminous, lignite and the like and coal extracts and the like. Heavy, aromatic, carbonaceous materials in general are suitable as feed to reactor 10. Particularly desirable results have been achieved wherein coal and coal extracts were used as a feed material.

In the practice of the present invention, a stream comprising finely divided coal, hydrogen, and molten zinc chloride is introduced into reactor 10 with the reactor being operated at a pressure of about 1000 to about 5000 p.s.i., a temperature of about 700 to about 1050° F, and a hydrogen partial pressure from about 1000 to about 5000 p.s.i. Particularly desirable results have been obtained when the reactor is operated at about 2000 to about 4000 p.s.i. and at a temperature from about 725 to about 850° F. Desirably, the zinc chloride is present in an amount greater than 50 weight percent based on the carbonaceous material charged to the reactor and it is believed that amounts of zinc chloride in excess of 200 weight percent result in no further improvement in the results. Desirably, the zinc chloride is present in an amount approximating 100 weight percent of the carbonaceous material introduced. In the recovery of the lower weight hydrocarbonaceous materials from the spent zinc chloride melt, distillation techniques known to those skilled in the art can be used. In the embodiment shown, the pressure is typically reduced step-wise to a pressure less than one atmosphere, and preferably as low as about 100 mm. of mercury in vessel 34. Clearly, such techniques are within the skill of those in the art and need not be discussed further. The spent melt remaining in vessel 34 after the pressure reduction contains residual quantities of hydrocarbonaceous material which typically boil at temperatures in excess of 475° F.

The recovery of hydrocarbonaceous materials from the spent melt in this vessel has been found to be improved by introducing into a lower portion 64 of vessel 34, a liquid low-boiling hydrocarbon stream. The stream typically has a boiling point below 200° C and preferably above 50° C. This stream typically corresponds to a gasoline-range material or lighter. The low-boiling solvent is introduced into vessel 34 as a liquid and tends to dissolve the heavy hydrocarbonaceous materials from the spent melt as it flashes thereby providing a synergistic improvement in the removal of these materials. In other words, the introduction of the low boiling solvent as a liquid tends to result in a solubility effect which is enhanced by the stripping effect created as the low-boiling hydrocarbon solvent vaporizes in situ, thus carrying over additional quantities of the heavy hydrocarbonaceous material. The recovery of additional quantities of the hydrocarbonaceous material at this point is highly desirable since the materials which remain with the spent melt as it passes into the regenerator are normally burned and excessive amounts of carbonaceous material can result in difficulty in controlling the temperature, the use of excessive amounts of oxygen and the like. Any carbonaceous material beyond that amount required to generate a suitable amount of heat to vaporize the zinc chloride in the regenerator is wasted unnecessarily if it can be recovered in any other way as a product. As indicated above, the liquid low-boiling hydrocarbon stream is introduced into lower portion 64 of vessel 34 and is desirably distributed relatively uniformly across the cross-sectional area of vessel 34 via a distributor 66. Such distribution means are well known to those skilled in the art and need not be discussed further. Clearly, the method of the present invention can be used in a continuous process as shown, or in a batch process. The method of operation is substantially the same in either a continuous or a batch process.

Further, the liquid low-boiling hydrocarbon stream can, if desired, be introduced in a similar manner into other vessels such as vessels 22 and 28. Desirably, the use of the low-boiling hydrocarbon stream is confined to those vessels wherein a major portion of the hydrocarbon product materials has been removed from the spent melt.

It has been observed that the use of the low-boiling hydrocarbon stream as described above does not appear to result in substantial degrading of the low boiling stream by further contact with the spent melt. In other words, the stream injected is normally recovered in substantially the same form as injected. The reaction of the stream with the spent melt appears to be minor, therefore the stream can be used for the recovery of the heavier hydrocarbonaceous materials without degradation and recycled to fractionation for recovery as a product.

Clearly, many process variations and modifications are possible within the scope of the present invention. For instance, various means for recovering the hydrocarbon products from the spent melt are possible and may be considered desirable by those skilled in the art. The improvement of the present invention is effective with any such methods wherein a spent melt which contains residual heavy hydrocarbon products is produced or is present in the process at an intermediate stage.

Having thus described the invention by reference to certain of its preferred embodiments, it is pointed out that the embodiments described are illustrative rather than limiting in nature and that many variations and modifications are possible within the scope of the present invention, many of which may appear obvious or desirable to those skilled in the art upon a review of the foregoing description of preferred embodiments.

Having thus described the invention, I claim:

1. In a process for hydrocracking heavy carbonaceous materials by contacting said heavy carbonaceous materials with hydrogen in the presence of a molten metal halide catalyst to produce hydrocarbons having a lower molecular weight and thereafter separating at least a major portion of said hydrocarbons from the spent molten metal halide, the improvement comprising separating a major portion of said hydrocarbons from said spent melt and thereafter injecting into said spent molten metal halide a liquid low-boiling hydrocarbon stream so that said liquid low-boiling hydrocarbon stream is vaporized in said spent molten metal halide thereby recovering additional quantities of heavy hydrocarbonaceous material from said spent molten metal halide.

2. The improvement of claim 1 wherein said metal halide is zinc halide.

3. The improvement of claim 2 wherein said low-boiling stream has a boiling point, at one atmosphere, below about 200° C.

4. The improvement of claim 3 wherein the boiling point of said low-boiling stream is greater than about 50° C.

5. The improvement of claim 1 wherein substantially all hydrocarbons having a boiling point below about 475° C have been removed from said molten zinc chloride prior to injection of said liquid low-boiling hydrocarbon stream.

* * * * *